United States Patent [19]

Gibbs

[11] Patent Number: 4,919,487

[45] Date of Patent: Apr. 24, 1990

[54] CHAIRS HAVING CROSS BAR SEAT SUPPORT

[75] Inventor: Terence Gibbs, Nyack, N.Y.

[73] Assignee: Omni Products International, Inc., Fairfield, N.J.

[21] Appl. No.: 402,832

[22] Filed: Sep. 5, 1989

[51] Int. Cl.[5] ..... A47C 1/12

[52] U.S. Cl. ..... 297/445; 52/312; 403/170; 297/452

[58] Field of Search ..... 297/445, 449, 452; 248/188.91; 403/10, 23, 185, 268, 170; 52/312, 716, 718, 242, 237, 234, 169

[56] References Cited

U.S. PATENT DOCUMENTS

| | | | |
|---|---|---|---|
| 2,270,656 | 1/1942 | Kiesecker | 248/188.91 X |
| 2,722,267 | 11/1955 | Liljengren | 297/452 X |
| 4,074,490 | 2/1978 | Nagase | 52/312 |
| 4,097,089 | 6/1978 | Peterson | 297/445 X |
| 4,674,799 | 6/1987 | Schwartz | 297/445 |

FOREIGN PATENT DOCUMENTS

| | | | |
|---|---|---|---|
| 2033526 | 5/1980 | United Kingdom | 403/23 |

*Primary Examiner*—James T. McCall

*Attorney, Agent, or Firm*—Lerner, David, Littenberg, Krumholz & Mentlik

[57] ABSTRACT

A chair structure is disclosed. The chair structure is provided with a chair seat section including first and second transversely spaced legs, a transverse cross brace fixed to and rigidly interconnecting the legs, first and second transversely spaced seat side support members having respective first and second end portions thereon, and a fabric extending between the seat side support members and forming a seat therebetween. The cross brace comprises an elongate member having a decorative outer side, first and second spaced apart end sections and an inner side. The inner side of the cross brace includes a support surface thereon for supporting the end portions of the seat side support members on the end sections of the elongate cross brace member, with the end portions of the seat side support members being substantially shielded from view, in front elevation, by the decorative outer side of the cross brace.

12 Claims, 3 Drawing Sheets

CHAIRS HAVING CROSS BAR SEAT SUPPORT

BACKGROUND OF THE INVENTION

This invention relates to chair structures and, more particularly, to seat support arrangements for light weight chair structures.

Conventional light weight chair structures generally include at least a forward pair of transversely spaced legs that are rigidly interconnected by a cross brace. Such chair structures also include transversely spaced seat side support members that are bolted to the legs at points above the cross brace, and a seat forming fabric that extends between the seat side support members. Separate fastening arrangements that extend through the sides of the chair legs are usually employed for fastening the seat side support members to the legs at one level, and for fastening the cross brace member to the legs at another level. Accordingly, as viewed from the side, the legs each have a number of discontinuities therein, which are usually covered by insert buttons. Similarly, as viewed from the front, the ends of the seat side support members may be seen extending out beneath the seat of the chair, vertically separated from the top of the cross brace.

The foregoing arrangement results in a chair that has visual discontinuities that are esthetically displeasing. In addition, the load carrying capacity of the seat section of such a chair is frequently limited.

It is, therefore, a primary object of this invention to provide an improved light weight chair structure that avoids some of the foregoing disadvantages of prior light weight chair structures.

Another object of the present invention is to provide a light weight chair structure having an improved seat support arrangement therein.

Yet another object of this invention is to provide a light weight chair structure having a seat support structure in which the seat side support members of the chair are supported on, and shielded from view by, an improved cross bar support structure.

Further objects and advantages of this invention will become apparent as the following description proceeds.

SUMMARY OF THE INVENTION

Briefly stated, and in accordance with one embodiment of this invention, an improved chair structure comprises a chair seat section including first and second transversely spaced legs, a transverse cross brace fixed to and rigidly interconnecting the legs, first and second transversely spaced seat side support members having respective first and second end portions, and means extending between the seat side support members for forming a seat therebetween. The cross brace comprises an elongate member having an outer side, first and second spaced apart end sections and an inner side. The inner side includes support means thereon for supporting the end portions of the seat side members on the end sections of the elongate cross brace member, with the end portions of the seat side members being substantially shielded from view, in front elevation, by the outer side.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION

Figure 1:
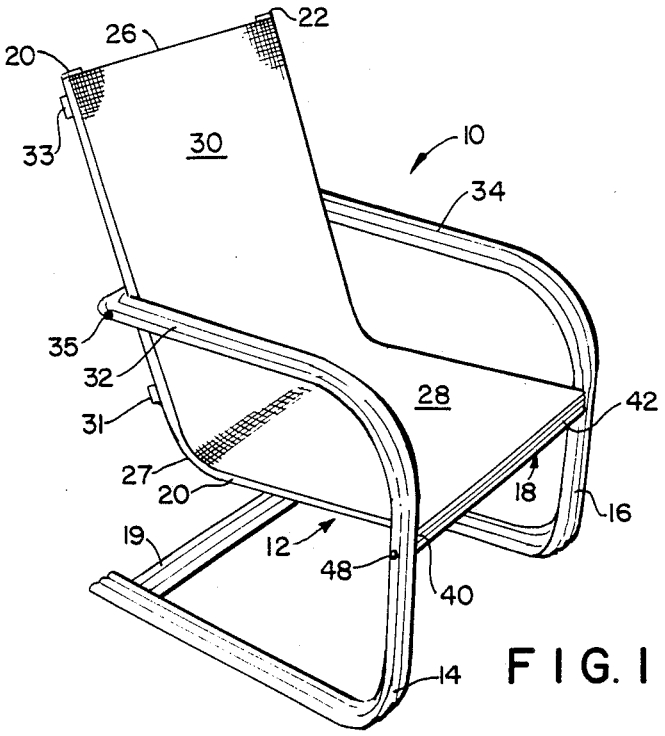
FIG. 1 is a perspective view of a light weight chair having a seat section that includes seat side support members carried by a cross brace, in accordance with one embodiment of this invention.
Figure 2:
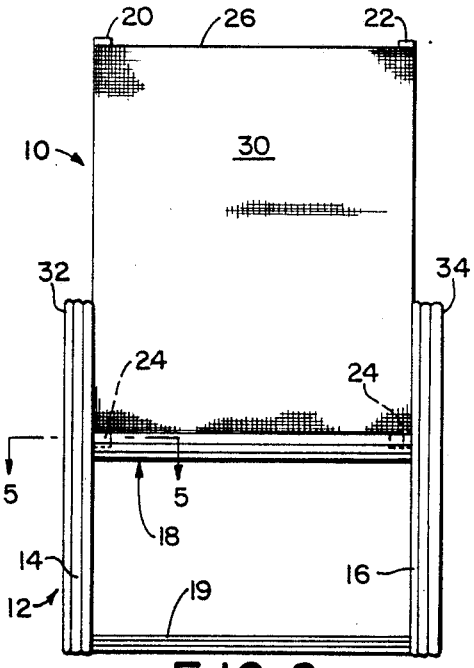
FIG. 2 is a front elevation view of the chair shown in FIG. 1.

Referring to FIGS. 1, 2, 4 and 5, a chair structure, shown generally at 10, has there been illustrated. The chair structure 10 is provided with a chair seat section, shown generally at 12, which includes first and second transversely spaced legs 14 and 16, respectively. The legs 14 and 16 are rigidly interconnected by a forward transverse cross brace, shown generally at 18, and a rear transverse cross brace 19 which are fixed at their opposite ends to the legs 14 and 16. The chair seat section 12 is provided with first and second transversely spaced seat side support members 20 and 22, respectively, each of which includes an end portion, one of which is shown at 24 in FIG. 4. The seat section 12 further includes a seat forming means, shown generally at 26, which extends between the seat side support members 20 and 22 to form a seat therebetween. The seat forming means 26 preferably comprises a conventional open mesh fabric, or other suitable flexible material, which extends between the transversely spaced seat side support members 20 and 22 and has its opposite sides fixed to such seat side support members, in accordance with known practices.

The seat side support members 20 and 22 are each provided with bends, one of which is shown at 27 (FIG. 1), so that the seat section 12 includes a seat portion 28 and a back rest portion 30. In addition, the seat section 12 is provided with arm rests 32 and 34 which, in the preferred embodiment, are extensions of the legs 14 and 16. The upper rear portions of arm rests 32 and 34 are fixed to the back rest portion 30 of the seat side support members 20 and 22 by suitable fasteners 35, for example the fasteners shown in copending U.S. patent application No. 229,875, filed Aug. 18, 1988, which is assigned to the assignee of the present invention and the disclosure of which is incorporated herein by reference. Conventional back cross braces 31 and 33 may be employed to rigidly interconnect the seat side support members 20 and 22 at a fixed distance from one another.

Figure 4:
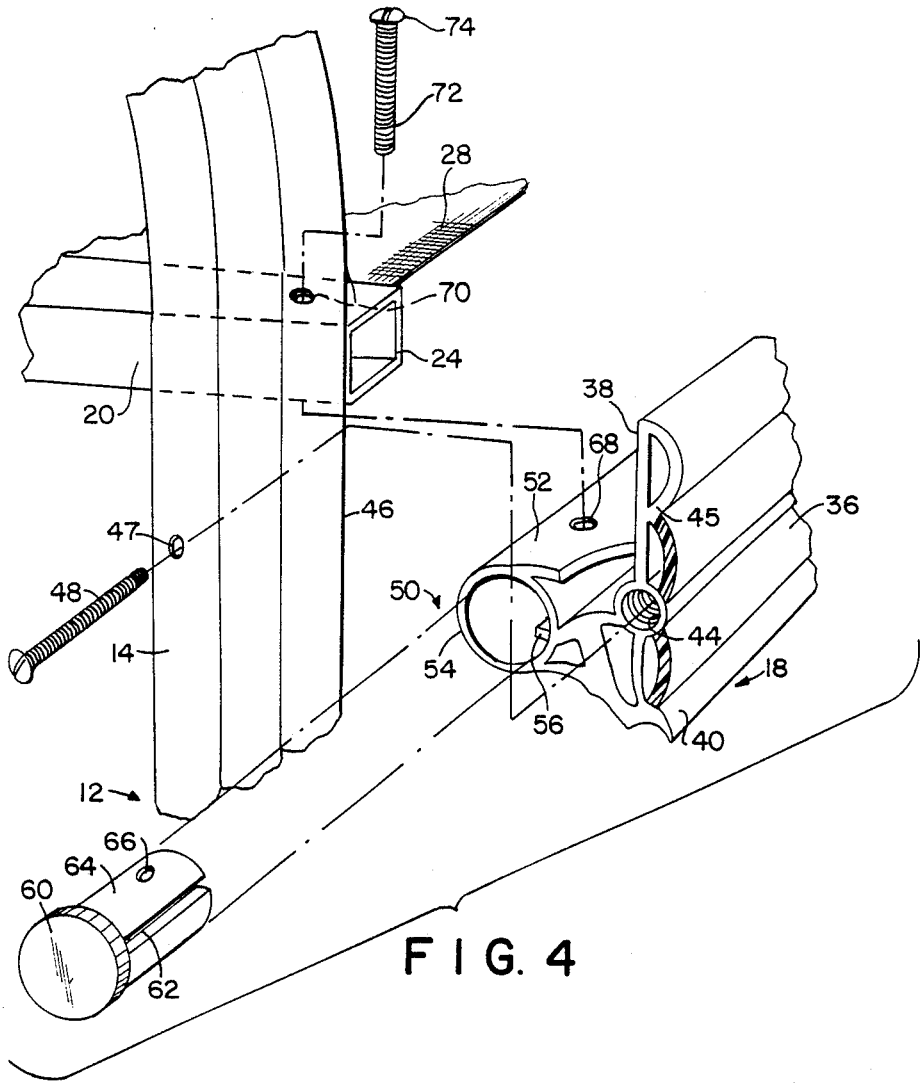
FIG. 4 is an enlarged, exploded, perspective view of a portion of the chair shown in FIG. 1 in accordance with one embodiment, with parts cut away for clarity, showing details of the cross brace, one of the seat side support members, and one of the legs of the chair structure.
Figure 5:
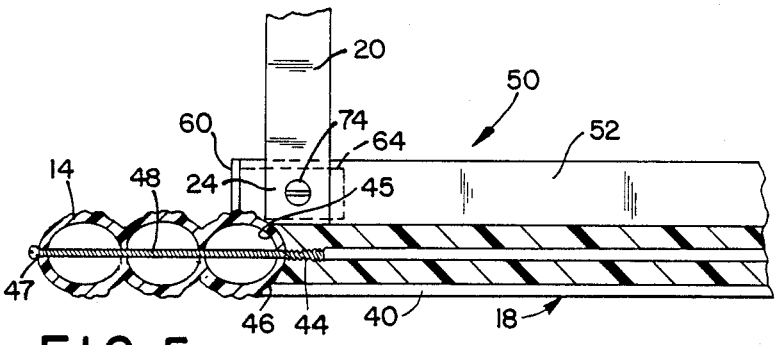
FIG. 5 is an enlarged sectional view, taken along the line 5—5 of FIG. 2.

Referring to FIGS. 4 and 5, the lower forward end portions 24 of the seat side support members 20 and 22 are supported on cross brace 18. Cross brace 18 comprises an elongate member, preferably an extrusion of polypropyene or acrylonitrile butadiene styrene, that includes a decorative outer side 36, an inner side 38 and longitudinally spaced apart end sections 40 and 42 (FIG. 1). End sections 40 and 42 are each provided with a longitudinally extending threaded aperture 44 (FIGS. 4 and 5) which is employed in rigidly fastening cross brace 18 to legs 14 and 16. The end edges of cross brace 18 are preferably concavely arcuate, as shown at 45, so as to mate with the side edges of legs 14 and 16, which are preferably convexly arcuate, as shown at 46. The legs 14 and 16 each include apertures therethrough, one of which is shown at 47, through which threaded support bolts 48 pass into threaded engagement with the threaded apertures 44 of the cross brace. Thus, when threaded bolts 48 are securely fastened to the threaded apertures 44 in the cross brace, a rigid connection is made between cross brace 18 and the legs 14 and 16. Alternatively, the fastening arrangement shown in said copending U.S. patent application No. 229,875 may be employed to fasten cross brace 18 to legs 14 and 16.

The inner side 38 of cross brace 18 includes a support means, shown generally at 50, for supporting the end portions 24 of seat side support members 20 and 22 thereon. Support means 50 generally comprises a shoulder 52 which extends rearwardly from the inner side 38 of cross brace 18, at a point intermediate the upper and lower edges thereof, so as to form a generally L-shaped surface, in cross section, on the inner side of the cross brace.

Referring more particularly now to FIGS. 4 and 5, the manner in which the end portions 24 of seat side support members 20 and 22 are fastened to the support means 50 of cross brace 18 will now be considered in greater detail. The extrusion which forms cross brace 18 includes an integral cylinder or cylindrical portion 54 therein which merges with shoulder 52 and forms a part of the support means 50. The interior of cylinder 54 is provided with an integral, longitudinally elongate, rib or key 56.

End plug members, one of which is shown at 60, are provided for insertion into the interior of cylinder 54, at the opposite end sections 40 and 42 of cross brace 18. The end plugs 60 are provided with slots or keyseats 62 formed in an outer cylindrical surface 64 of the plugs. The keyseats 62 are adapted to be engaged by the key 56 on the interior of cylinder 54 when the end plugs 60 are inserted into the interior of the cylinder. Threaded, transversely extending apertures 66 are provided in the outer cylindrical surfaces 64 of end plugs 60. When the end plugs 60 are inserted fully into the interior of cylinder 54, the engagement of key 56 and keyseats 62 positions the apertures 66 in alignment with corresponding apertures 68 formed in the shoulder 52 of cross brace 18.

The end portions 24 of seat side support members 20 and 22 are also provided with apertures 70 which align with the apertures 66 and 68 when the chair structure 10 is assembled. Threaded bolts 72, having enlarged heads 74 thereon, are passed through the apertures 70 of the seat side support members 20 and 22, and through the apertures 68 in the shoulders 52 of cross brace 18, into threaded engagement with the threaded apertures 66 of end plugs 60. When the bolts 74 are tightened firmly into the threaded apertures 66, the end portions 24 of seat side support members 20 and 22 are drawn firmly into contact with the shoulder 52 at the respective opposite ends 40 and 42 of cross brace 18. Alternatively, an arrangement similar to that employed in fastening the end edges of cross brace 18 to the side edges of legs 14 and 16 may be employed to fasten the end portions 24 of seat side support arms 20 and 22 to the inside edges of the legs 14 and 16, with the bottoms of the end portions 24 resting on the shoulder 52 of cross brace 18 without being bolted thereto. This arrangement would employ a threaded bolt and threaded aperture arrangement similar to the threaded bolt 48 and threaded aperture 44 which is used to rigidly interconnect the cross brace 18 to the side edges of the legs 14 and 16.

The legs 14 and 16, arm rests 32 and 34, and seat side support members 20 and 22 are preferably metallic tubular members that are coated with decorative protective polyvinyl chloride coatings. Alternatively, such members, as well as cross brace 18, may be extrusions of a strong, light weight material, for example polypropylene or acrylonitrile butadiene styrene.

Figure 3:
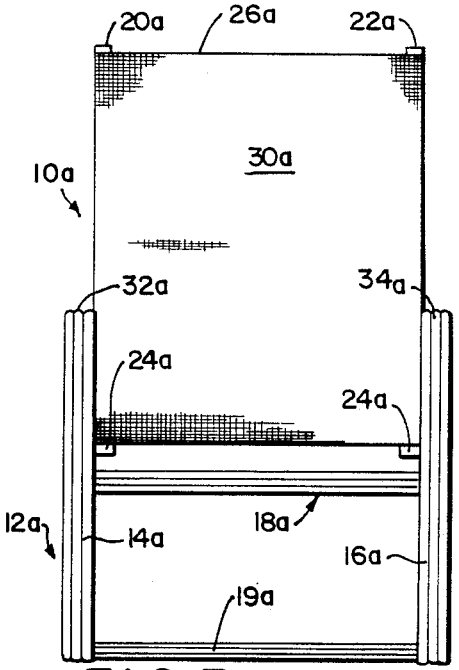
FIG. 3 (PRIOR ART)
FIG. 3 is a front elevation view of a prior art form of light weight chair of the type shown in FIG. 1.

Referring to FIG. 3, a prior art light weight chair structure that is similar to the chair structure shown in FIGS. 1, 2, 4 and 5 but does not include the improvements of the present invention therein has there been illustrated. Parts in the chair structure of FIG. 3 which correspond to parts in the chair structure of FIGS. 1, 2, 4 and 5 have been designated with similar numbers that are followed by the letter "a". For example, the prior art chair structure of FIG. 3 has been illustrated generally at **10*a*, the legs of the chair structure 10*a* are identified at 14*a* and 16*a*, the seat side support members are identified at 20*a* and 22*a* and the forward ends of the seat side support members are identified at 24*a***.

The chair structure of FIG. 3 includes a conventional prior art cross brace **18*a*, rather than the improved cross brace 18 (FIGS. 1, 2, 4 and 5) of the present invention. Prior art cross brace 18*a* is fixed to and rigidly interconnects the legs 14*a* and 16*a* at a level that is lower than the level of the cross brace 18 of the present invention. Accordingly, the forward end portions 24*a* of the prior art seat side support members 20*a* and 22*a* are exposed to an observer's view in front elevation, as is clearly shown in FIG. 3. Also, the front end portions 24*a* are not directly supported on the cross brace 18*a* and, thus, require additional esthetically displeasing fasteners (not shown) to fix them to the legs 14*a* and 16*a***.

Figure 6:
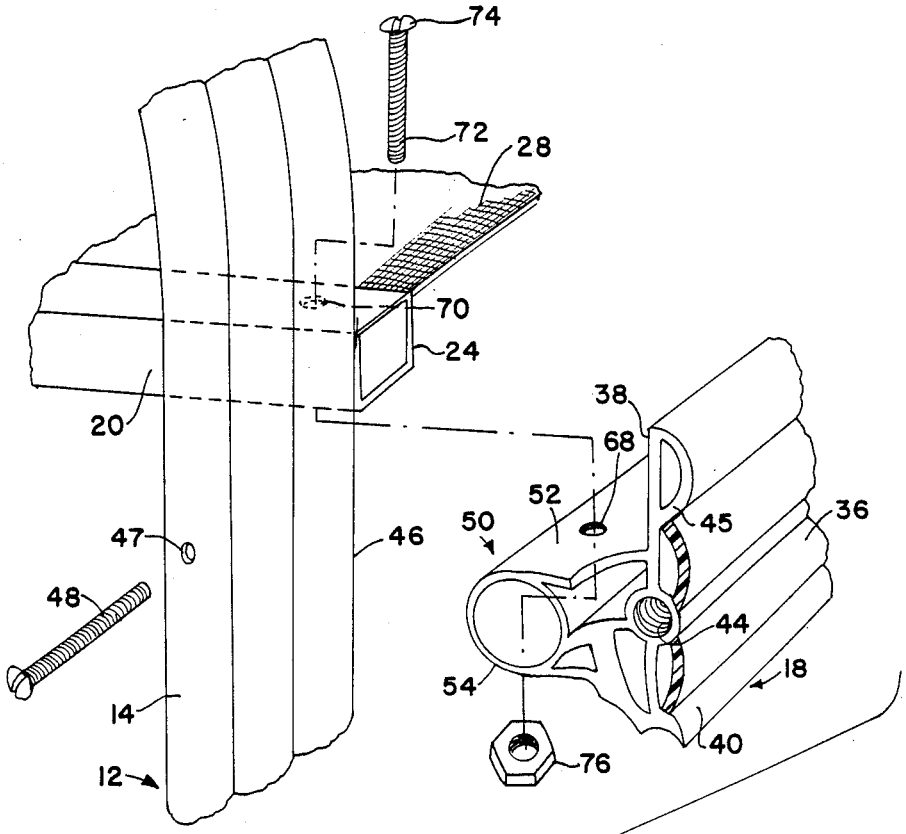
FIG. 6 is an enlarged, exploded, perspective view of a portion of the chair shown in FIG. 1 in accordance with another embodiment, with parts cut away for clarity, showing details of the cross brace, one of the seat side support members, and one of the legs of the chair structure.

Referring to FIG. 6, the manner in which the end portions 24 of seat side support members 20 and 22 are fastened to the support means 50 of the cross brace 18 will be considered in accordance with another embodiment of the present invention. In this regard, the integral, longitudinally elongate, rib or key 56 and end plug members 60 shown in the FIG. 4 embodiment are eliminated. Rather, bolts 74 are secured by means of nuts 76 received within the interior of cylinder 54. Optionally, an end plug (not shown) of conventional design may be inserted into the mouth of cylinder 54 for closing same.

From the foregoing description, it will be apparent that an improved light weight chair structure with fewer esthetically displeasing visual discontinuities has been provided by this invention. In addition, the ability of the chair structure to withstand the loads that may be imposed on the chair in service has been improved. These advantages result from the provision of a chair structure in which the seat side support members are supported on, and shielded from view by, an improved cross bar arrangement.

While there have been shown and described what are presently considered to be the preferred embodiments of this invention, it will be apparent to those skilled in the art that various other changes and modifications may be made without departing from the broader aspects of this invention. It is, therefore, aimed in the appended claims to cover all such changes and modifications as fall within the true spirit and scope of this invention.

What is claimed is:

1. In a chair structure having a chair seat section including first and second transversely spaced legs, a transverse cross brace fixed to and rigidly interconnecting said legs, first and second transversely spaced seat side support members having respective first and second end portions, and means extending between said seat side support members for forming a seat therebetween, the improvement wherein said cross brace comprises an elongate member having an outer side, first and second spaced apart end sections and an inner side, said inner side including support means thereon for supporting said end portions of said seat side support members on said end sections of said elongate cross brace member, with said end portions of said seat side support members being substantially shielded from view, in front elevation, by said outer side.

2. A chair structure according to claim 1, further including first and second means interconnecting said first and second end sections of said elongate cross brace member with respective ones of said first and second end portions of said seat side support members for rigidly fastening said seat side support members to said cross brace.

3. A chair structure according to claim 2, wherein said elongate cross brace member includes upper and lower edges thereon, and wherein said support means on said inner side of said elongate cross brace member includes a shoulder extending rearwardly from said inner side intermediate said upper and lower edges to thereby form an L-shaped surface, in cross-section, on said inner side.

4. A chair structure according to claim 3, wherein said elongate cross brace member comprises an extrusion, said extrusion including an integral cylindrical portion longitudinally co-extensive with and merging into said shoulder of said elongate cross brace member.

5. A chair structure according to claim 4, further including first and second securing means positioned within said cylindrical portion of said extrusion at the respective end sections of said elongate cross brace member, said securing means being engaged by respective ones of said fastening mean and cooperating therewith in fastening said seat side support members to said cross brace.

6. A chair structure according to claim 4, further including first and second cylindrical end plug members positioned within and reinforcing said cylindrical portion of said extrusion at the respective end sections of said elongate cross brace member, said end plug members being engaged by respective ones of said fastening means and cooperating therewith in fastening said seat side support members to said cross brace.

7. A chair structure according to claim 6, wherein said end plug members are keyed to said cylindrical portion of said extrusion to align said plug members within said cylindrical portions for engagement by said fastening means.

8. A chair structure according to claim 7, wherein said end portions of said seat side support members and said end sections of said elongate cross brace member are provided with aligned apertures, and wherein said fastening means each include a threaded bolt which passes through said aligned apertures into threaded engagement with a corresponding one of said end plug members.

9. A chair structure according to claim 1, wherein said elongate cross brace member includes upper and lower edges thereon, and wherein said support means on said inner side of said elongate cross brace member includes a shoulder extending rearwardly from said inner side intermediate said upper and lower edges to thereby form an L-shaped surface, in cross-section, on said inner side.

10. A chair structure according to claim 9, wherein said elongate cross brace member comprises an extrusion, said extrusion including an integral cylindrical portion longitudinally co-extensive with and merging into said shoulder of said elongate cross brace member.

11. A chair structure according to claim 10, further including first and second cylindrical end plug members positioned within and reinforcing said cylindrical portion of said extrusion at the respective end sections of said elongate cross brace member, said end plug members being keyed to said cylindrical portion of said extrusion to align said plug members with respect to said cylindrical portions.

12. A chair structure according to claim 1, wherein each of said transversely spaced legs of said chair seat section includes a convexly arcuate side edge, and wherein said elongate cross brace member includes concavely arcuate end edges which match with and receive the convexly arcuate side edges of said legs.

* * * * *